US007283767B1

(12) United States Patent
Hagimoto

(10) Patent No.: US 7,283,767 B1
(45) Date of Patent: Oct. 16, 2007

(54) IMAGE FORMING APPARATUS AND POLISHING METHOD FOR IMAGE CARRIER

(75) Inventor: Noritoshi Hagimoto, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 11/517,489

(22) Filed: Sep. 8, 2006

(30) Foreign Application Priority Data

May 10, 2006 (JP) ..... 2006-130920

(51) Int. Cl.
*G03G 15/30* (2006.01)

(52) U.S. Cl. ..... 399/149; 399/347; 399/350; 399/351

(58) Field of Classification Search ..... 399/149, 399/347, 350, 351
See application file for complete search history.

(56) References Cited

U.S. PATENT DOCUMENTS 5,678,143 A 10/1997 Nagahara et al.
5,752,151 A * 5/1998 Inoue et al. ..... 399/350
5,778,285 A 7/1998 Nagahara et al.
7,065,316 B2 * 6/2006 Yanagida et al. ..... 399/350
7,110,696 B2 * 9/2006 Murakami et al. ..... 399/101
2002/0039506 A1 * 4/2002 Suzuki ..... 399/350
2005/0153223 A1 * 7/2005 Kojima et al. ..... 430/66
2006/0216082 A1 * 9/2006 Kojima ..... 399/350

FOREIGN PATENT DOCUMENTS

JP 05-181306 7/1993
JP 2003-084518 3/2003

OTHER PUBLICATIONS

English translation of JPO PN 2003-084518.*

* cited by examiner

*Primary Examiner*—David M. Gray
*Assistant Examiner*—Geoffrey T Evans
(74) *Attorney, Agent, or Firm*—Buchanan Ingersoll & Rooney PC

(57) ABSTRACT

An image forming apparatus comprises: an image carrier driven into rotation; a charger for electrically charging a surface of the image carrier; a latent image forming unit for forming an electrostatic latent image on the charged image carrier surface; a developing unit for forming a toner image by supplying a toner to an area of the electrostatic latent image formed on the image carrier surface; a transferring unit for transferring the toner image formed on the image carrier surface to a transfer medium; and a non-rotary type polishing member employing a foamed elastic material, the polishing member contacted against the surface of the image carrier at place downstream from the transferring unit in a moving direction of the image carrier and between the transferring unit and the charger, and reciprocally moved in a direction intersecting with the moving direction of the image carrier.

14 Claims, 8 Drawing Sheets

(A)

(B)

(C)

(A)

(B)

IMAGE FORMING APPARATUS AND POLISHING METHOD FOR IMAGE CARRIER

RELATED APPLICATION

This application is based on an application No. 130920/2006 filed in Japan, the contents of which are hereby incorporated by reference.

BACKGROUND OF THE INVENTION

1. Field of the Invention

The present invention relates to an image forming apparatus utilizing an electrophotographic system, such as copiers and printers, as well as to a polishing method for image carrier. Particularly, in an image forming apparatus including: an image carrier driven into rotation; a charger for electrically charging a surface of the image carrier; a latent image forming unit for forming an electrostatic latent image on the charged image carrier surface; a developing unit for forming a toner image by supplying a toner to an area of the electrostatic latent image formed on the image carrier surface; and a transferring unit for transferring the toner image, formed on the image carrier surface, to a transfer medium, the invention is characterized by reducing the abrasion or marring of the image carrier surface, thereby properly preventing the toner remaining on the image carrier surface after image transfer from filming as fused to the surface of the image carrier.

2. Description of the Related Art

In the image forming apparatus utilizing the electrophotographic system, such as copiers and printers, it is a conventional practice to form an electrostatic latent image as follows. As shown in FIG. 1, a surface of a rotating image carrier 1 is electrically charged by means of a charger 2. Subsequently, a latent image forming unit 3 employing a laser or the like irradiates light on the surface of the image carrier 1 according to image information, thereby forming the electrostatic latent image on the image carrier surface 1.

A developing unit 4 supplies a toner t to an area of the electrostatic latent image thus formed on the image carrier surface 1, thereby forming a toner image on the image carrier surface 1 in correspondence to the electrostatic latent image. Then, the toner image thus formed on the image carrier surface 1 is transferred to a recording sheet 6 as the transfer medium by means of a transferring unit 5. On the other hand, the toner t remaining on the image carrier surface 1 after the image transfer is removed from the image carrier surface 1 by means of a cleaner 7. Subsequently, the charger 2 electrically charges the surface of the image carrier 1 in the aforementioned manner. The image formation is carried out by repeating the above operations.

In the above case where the toner t remaining on the image carrier surface 1 is removed by the cleaner 7, the toner t is wastefully consumed because it is a general practice to dispose of the collected toner t. In addition, the disposal of the waste toner t poses a problem.

Recently, therefore, a cleaner-less image forming apparatus has been developed, wherein the above cleaner is omitted and wherein the aforesaid developing unit operates to supply the toner to the area of the electrostatic latent image formed on the image carrier and to collect the toner remaining on an area of the image carrier, which area does not carry the toner image.

However, such a cleaner-less image forming apparatus has the following problem. If a large quantity of toner remains on the image carrier surface after image transfer, the residual toner on the image carrier surface may produce a poorly charged area or may disable the latent image forming unit to form a proper electrostatic latent image. In consequence, the formed images may suffer density irregularities or an afterimage may appear in the subsequently formed image.

More recently, therefore, image forming apparatuses have been proposed wherein a dispersing member such as a foam roller or rotary brush is brought into contact against the image carrier surface for dispersing the toner remaining on the image carrier surface after image transfer, while the developing unit collects the toner thus dispersed (U.S. Pat. No. 5,678,143; U.S. Pat. No. 5,778,285 and Japanese Unexamined Patent Publication No. 2003-84518).

However, in the above constitution wherein the toner remaining on the image carrier surface after image transfer is dispersed by the dispersing member such as the foam roller or rotary brush, so as to be collected by the developing unit, the developing unit is incapable of adequately removing, from the image carrier surface, the residual toner after image transfer, an external additive of the toner or corona products produced during the charging process. Hence, these substances are fused to the image carrier surface to form film, which degrades the quality of the formed images.

In the prior art, a proposal has been made to add abrasive particles to the toner such that the surface of the image carrier may be polished by way of the abrasive particles (see Japanese Unexamined Patent Publication No. H5(1993)-181306).

In the image forming apparatus designed to polish the image carrier surface by way of the abrasive particles, the abrasive particles and the toner are collectively collected by the developing unit. Hence, the apparatus has the same problems as those of the conventional apparatuses. Furthermore, the abrasive particles heavily abrade the surface of the image carrier so that the image carrier is increased in the surface roughness, thus adversely affecting the image to be formed.

SUMMARY OF THE INVENTION

In an image forming apparatus including: an image carrier driven into rotation; a charger for electrically charging a surface of the image carrier; a latent image forming unit for forming an electrostatic latent image on the charged image carrier surface; a developing unit for forming a toner image by supplying a toner to an area of the electrostatic latent image formed on the image carrier surface; and a transferring unit for transferring the toner image formed on the image carrier surface to a transfer medium, an object of the invention is to reduce abrasion or marring of the image carrier surface so as to prevent the toner and the like remaining on the image carrier surface after image transfer from filming as fused to the image carrier surface.

An image forming apparatus according to the invention comprises: an image carrier driven into rotation; a charger for electrically charging a surface of the image carrier; a latent image forming unit for forming an electrostatic latent image on the charged image carrier surface; a developing unit for forming a toner image by supplying a toner to an area of the electrostatic latent image formed on the image carrier surface; a transferring unit for transferring the toner image formed on the image carrier surface to a transfer medium; and a non-rotary type polishing member employing a foamed elastic material, the polishing member contacted against the surface of the image carrier at place downstream from the transferring unit in a moving direction of the image carrier and between the transferring unit and the charger, and reciprocally moved in a direction intersecting with the moving direction of the image carrier.

In the image forming apparatus according to the invention, the non-rotary type polishing member employing the foamed elastic material is contacted against the surface of the image carrier at place downstream from the transferring unit in the moving direction of the image carrier and between the transferring unit and the charger and is reciprocally moved in the direction intersecting with the moving direction of the image carrier. Therefore, the surface of the image carrier is properly polished by the polishing member so that the abrasion or marring of the image carrier surface is reduced while the toner and the like remaining on the image carrier surface after image transfer are positively prevented from filming as fused to the image carrier surface. Thus is ensured that images of good quality are formed in a stable manner.

These and other objects, advantages and features of the invention will become apparent from the following description taken in conjunction with the accompanying drawings which illustrate specific embodiment of the invention.

DESCRIPTION OF THE PREFERRED EMBODIMENTS

An image forming apparatus according to an embodiment of the invention will be specifically described with reference to the accompanying drawings. It is to be noted that the image forming apparatus according to the invention is not limited to those illustrated by the following embodiments and may be modified as needed so long as such a modification does not depart from the scope of the invention.

Figure 1:
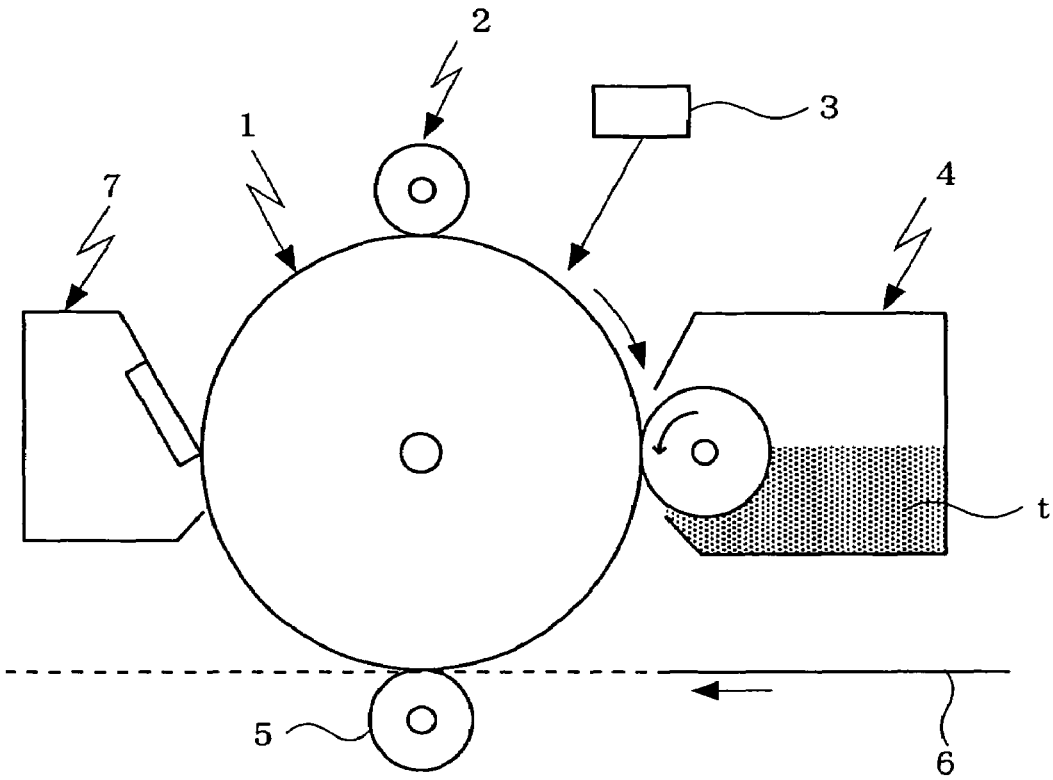
Fig. 1 Prior Art
FIG. 1 is a schematic diagram explanatory of a conventional image forming apparatus employing a cleaner.
Figure 2:
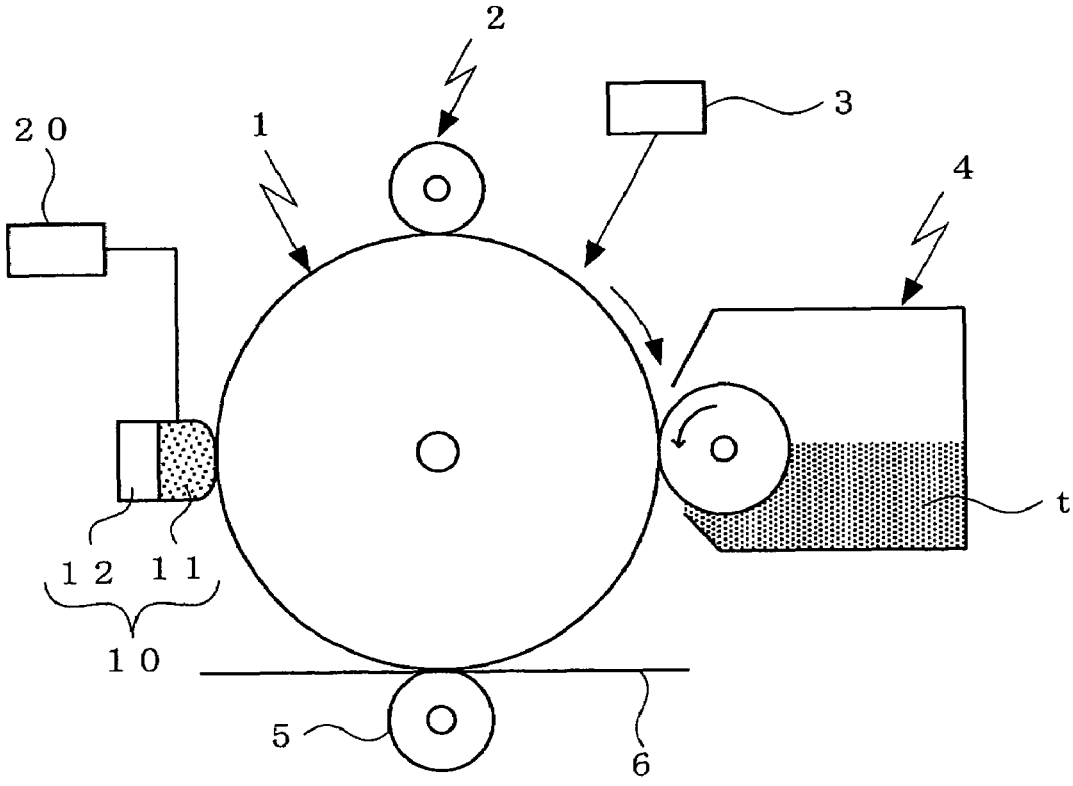
FIG. 2 is a schematic diagram explanatory of an image forming apparatus according to one embodiment of the invention.

The image forming apparatus of the embodiment is adapted to form an electrostatic latent image on a surface of an image carrier 1 as follows. As shown in FIG. 2, the surface of the rotating image carrier 1 is electrically charged by a charger 2. Subsequently, a latent image forming unit 3 employing a laser or the like irradiates light on the surface of the image carrier 1 according to image information, thereby forming the electrostatic latent image on the image carrier surface 1.

Subsequently, a developing unit 4 supplies a toner t to an area of the electrostatic latent image thus formed on the image carrier surface 1, thereby forming a toner image on the image carrier surface 1 in correspondence to the electrostatic latent image. The toner image thus formed on the image carrier surface 1 is transferred to a recording sheet 6 as a transfer medium by means of a transferring unit 5.

Figure 3:
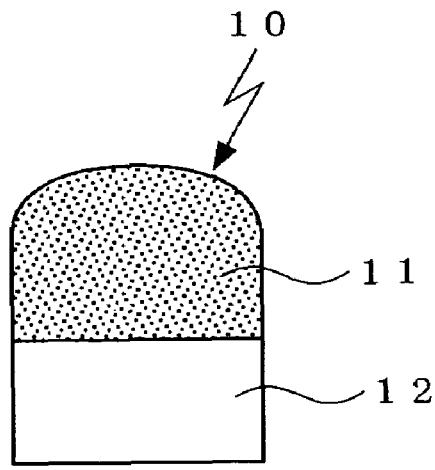
FIG. 3 is a schematic diagram explanatory of a polishing member used in the image forming apparatus of the above embodiment.
Figure 4:
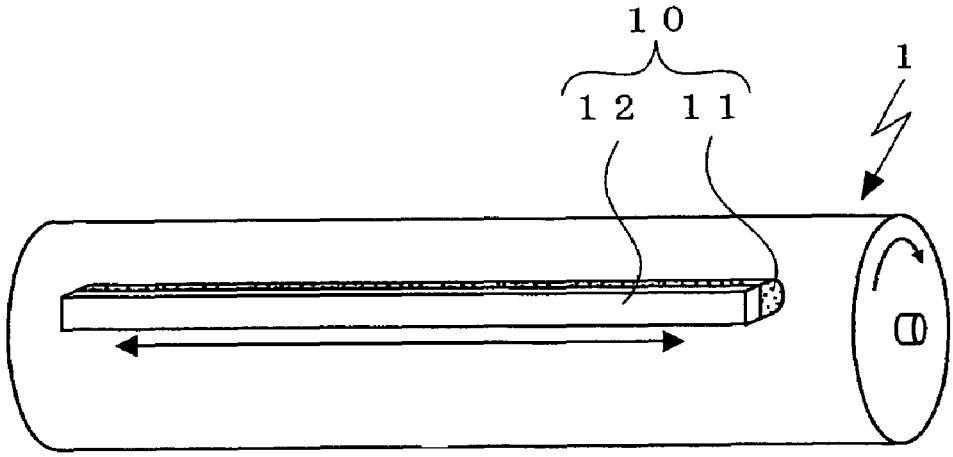
FIG. 4 is a schematic diagram showing how the above polishing member is reciprocally moved in an axial direction of an image carrier of the image forming apparatus of the above embodiment.

The image forming apparatus according to the embodiment employs a polishing member 10 comprising a foamed elastic material 11 affixed to a base 12, as shown in FIG. 3. As shown in FIG. 2, the foamed elastic material 11 of the polishing member 10 is contacted against the image carrier surface 1 after the transfer of the toner image to the recording sheet 6. As shown in FIG. 4, the polishing member 10 is reciprocally moved along an axial direction of the image carrier 1, the axial direction intersecting with a moving direction of the image carrier 1. Thus, the image carrier surface 1 is polished by means of the polishing member 10 so that the toner t and the like are prevented from being fused to the image carrier surface 1. In addition, a bias voltage from a bias source 20 is applied to the polishing member 10 for properly controlling the electric charge of the toner t remaining on the image carrier surface 1.

Figure 5:
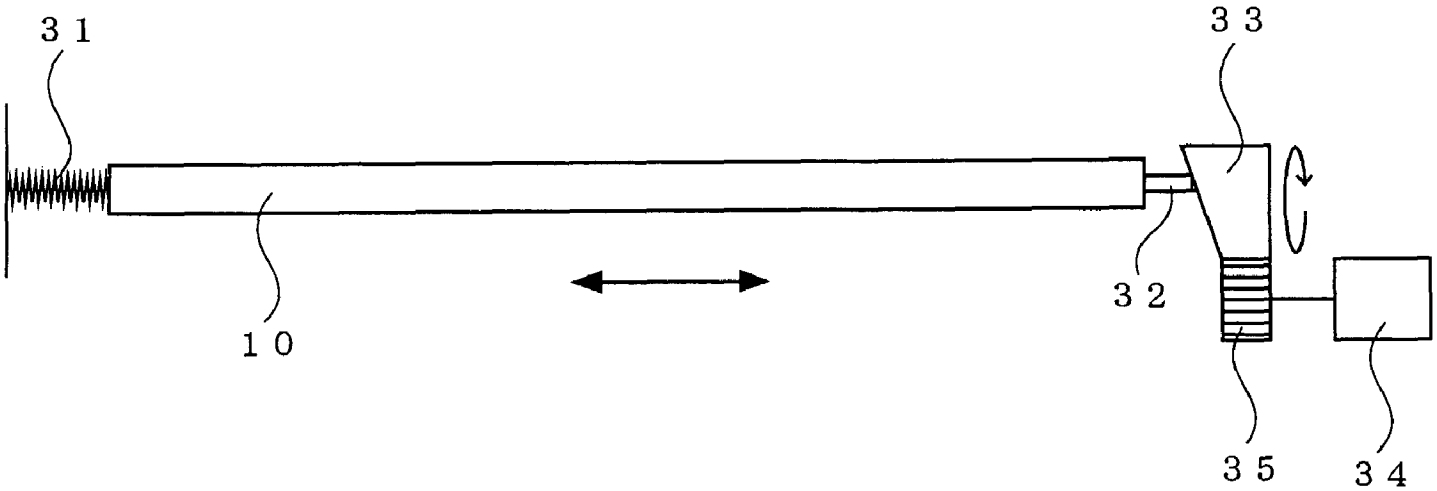
FIG. 5 is a schematic diagram showing one exemplary method of reciprocally moving the above polishing member in the axial direction of the image carrier of the image forming apparatus according to the above embodiment.
Figure 6:
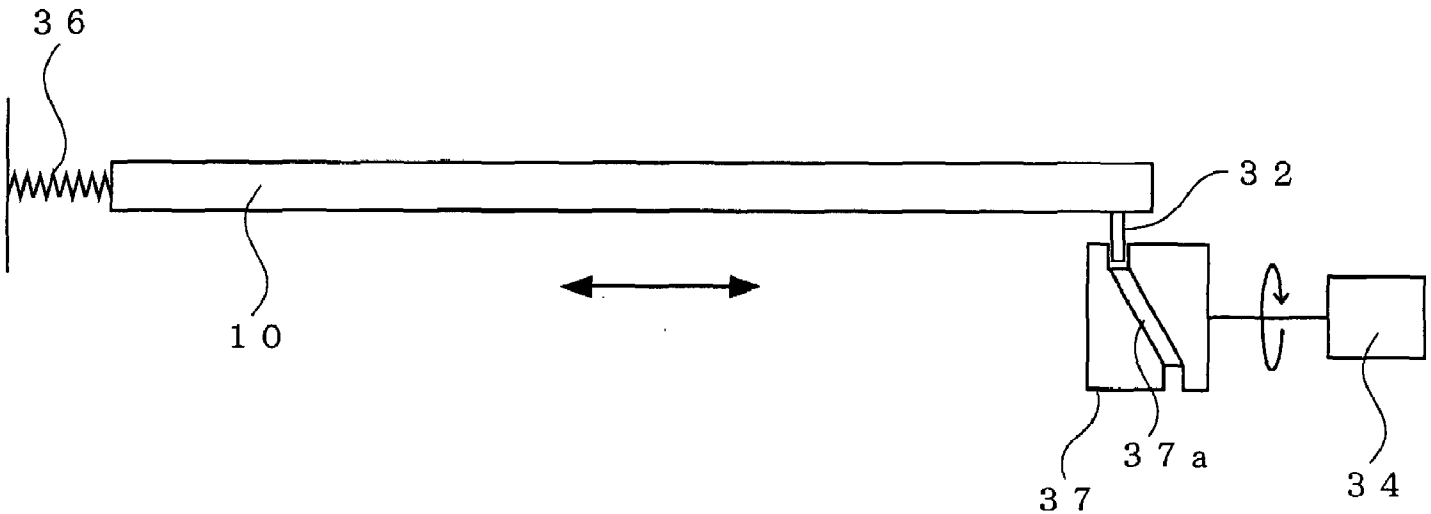
FIG. 6 is a schematic diagram showing another exemplary method of reciprocally moving the above polishing member in the axial direction of the image carrier of the image forming apparatus according to the above embodiment.

A variety of means may be employed for reciprocally moving the polishing member 10 along the axial direction of the image carrier 1. As shown in FIG. 5, for example, a compression spring 31 disposed at one end of the polishing member 10 may press a guide member 32 against a cam member 33, the guide member projected from the other end of the polishing member 10. In this state, a drive motor 34 rotates the cam member 33 via a gear 35, whereby the polishing member 10 is reciprocally moved in conjunction with the rotation of the cam member 33. Alternatively, the polishing member 10 may also be reciprocally moved as follows. As shown in FIG. 6, an extension spring 36 disposed at one end of the polishing member 10 may pull the polishing member toward the one end thereof, whereas the guide member 32 projected downwardly from the other end of the polishing member 10 has one end thereof fitted in a guide groove 37*a* which is formed in an outer periphery of a rotary member 37 as inclined relative to a circumferential direction of the rotary member. In this state, the drive motor 34 rotates the rotary member 37 whereby the polishing member 10 is reciprocally moved by means of the guide member 32 fitted in the guide groove 37*a*. Otherwise, a cylinder, rack and pinion gear or the like (not shown) may also be used for reciprocally moving the polishing member 10. The above drive motor 34 may also serve the purpose of rotating the image carrier 1.

Subsequently, the charger 2 electrically charges the surface of the image carrier 1 in the aforementioned manner. The latent image forming unit 3 is operated to form an electrostatic latent image on the image carrier surface 1 and then, the developing unit 4 supplies the toner t to the surface of the image carrier 1 to form a toner image corresponding to the electrostatic latent image. Furthermore, the developing unit 4 collects the toner t remaining on an area of the image carrier surface, the area not carrying the toner image. In this case, the residual toner t on the image carrier surface 1 is properly charged by means of the polishing member 10, so that the toner t may be adequately collected by the developing unit 4.

When the polishing member 10 is contacted against the image carrier surface 1 in the aforementioned manner, it is preferred to control the contact pressure of the polishing member to a range of 0.02 MPa to 0.05 MPa. The polishing member 10 may preferably employ a soft foamed material like foamed polyurethane as the foamed elastic material 11. If the formed elastic material 11 has an excessively great volume resistance, it is difficult for the bias source 20 to properly charge the residual toner t on the image carrier surface 1. It is therefore preferred to disperse carbon or the like in the foamed elastic material such that the foamed elastic material may have a volume resistance on the order of $10^4$ to $10^8\Omega$.

When the bias source 20 applies the bias voltage to the polishing member 10 for properly controlling the electric charge of the toner t remaining on the image carrier surface 1, the bias source 20 may preferably vary the bias voltage applied to the polishing member 10 according to use conditions including environment and the like. In a case where the toner t is negatively charged, for example, the bias source may preferably apply a bias voltage on the order of −300V under low temperature/low humidity conditions, a bias voltage on the order of −500V under normal conditions, or a bias voltage on the order of −700V under high temperature/high humidity conditions. In a case where there is a large quantity of toner t charged in reverse polarity, the bias source may preferably apply a bias voltage on the order of −1000V. Conversely, in a case where there is a large quantity of high charge toner t, the bias source may preferably apply a bias voltage on the order of +500V. The bias source may preferably apply a bias voltage on the order of −500V during the image forming operation. When the apparatus performs the cleaning operation rather than the image forming operation, the bias source may preferably apply a bias voltage on the order of −700V. In this manner, the bias source may vary the bias voltage applied to the polishing member 10 depending upon the respective conditions.

Figure 7:
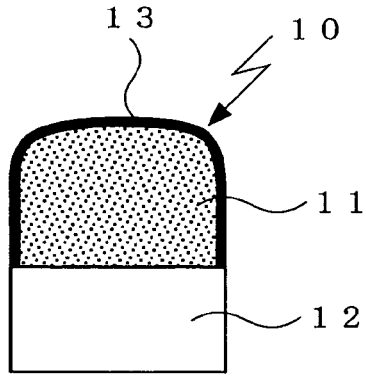
FIG. 7 is a group of schematic diagrams showing modifications of the polishing member used in the image forming apparatus of the above embodiment.
Figure 7:
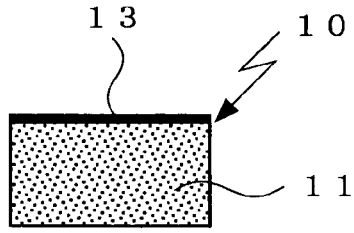
Figure 7:
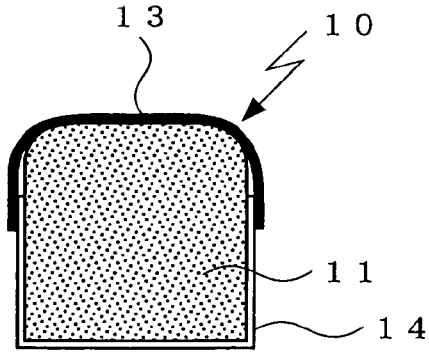

While the embodiment uses the polishing member 10 which comprises the foamed elastic material 11 affixed to the base 12 and which has a configuration wherein a portion to contact the image carrier 1 is defined by a protruded curve as seen in a vertical section with respect to a longitudinal direction of the base 12, the polishing member 10 is not limited to this. Other usable polishing members may be configured as follows, for example. As shown in FIG. 7A, a polishing member comprises the foamed elastic material 11 affixed to the base 12, and a conductive film 13 bonded to a surface of the foamed elastic material. As shown in FIG. 7B, a polishing member comprises the foamed elastic material and the conductive film 13 bonded to the surface thereof. As shown in FIG. 7C, a polishing member comprises the foamed elastic material 11 accommodated in a case 14 in a manner to protrude therefrom, and the conductive film 13 covering the surface of the foamed elastic material 11 and fixed to the case 14.

Figure 8:
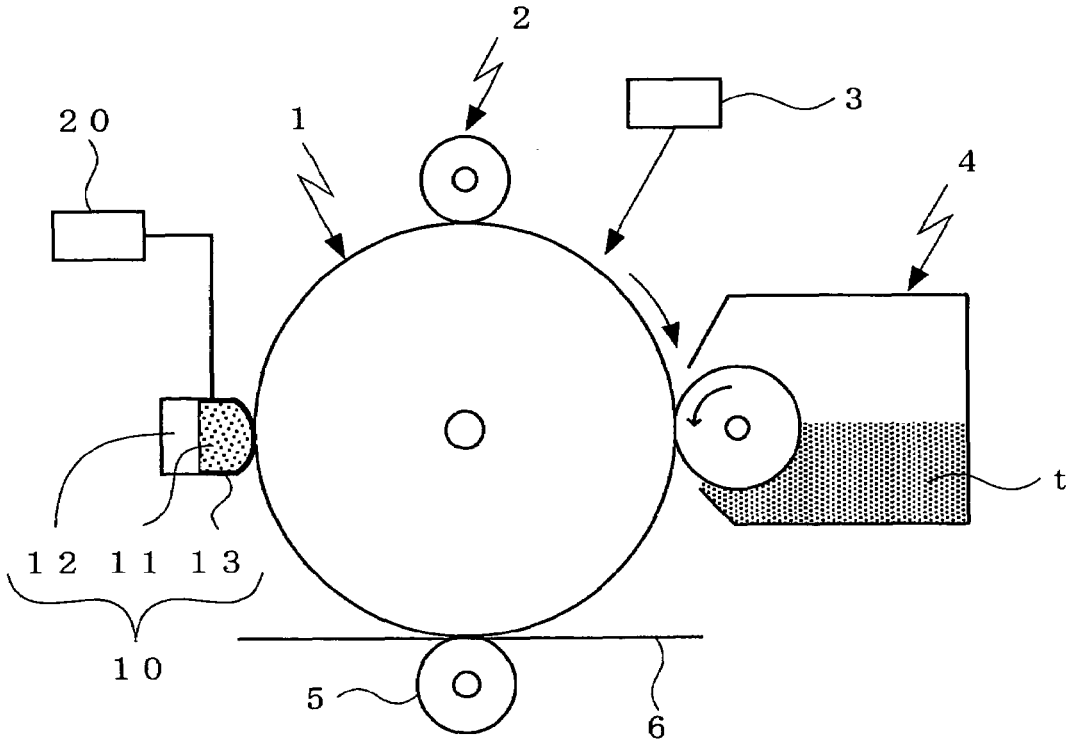
FIG. 8 is a schematic diagram showing an image forming apparatus employing one of the above modifications of the polishing member.

The polishing member 10 comprising the foamed elastic material 11 with the conductive film 13 overlaid on its surface may be used as follows. As shown in FIG. 8, the conductive film 13 overlaid on the foamed elastic material 11 is contacted against the image carrier surface 1 at a predetermined pressure, while this polishing member 10 is reciprocally moved in the axial direction of the image carrier 1, as described above, the axial direction intersecting with the moving direction the image carrier 1.

When the conductive film 13 overlaid on the surface of the foamed elastic material 11 is contacted against the image carrier surface 1 at the predetermined pressure and reciprocally moved along the axial direction of the image carrier 1, the polishing material 10 wherein, as shown in FIG. 7A or FIG. 7B, the conductive film 13 is bonded to the surface of the foamed elastic material 11 may preferably be used in order to prevent the conductive film 13 from becoming unable to accomplish uniform contact as being displaced from the foamed elastic material 11.

The conductive film 13 may preferably have a thickness on the order of 50 to 200 μm such that the conductive film may have a sufficient resistance against abrasion and achieve a proper contact pressure when the conductive film in contact against the image carrier surface 1 is reciprocally moved along the axial direction of the image carrier 1, as described above. In addition, the conductive film 13 may preferably have a surface resistance on the order of $10^4$ to $10^8\Omega$ because if the conductive film 13 has an excessively great surface resistance, the bias source 20 cannot properly charge the toner t remaining on the image carrier surface 1.

As described above, the image forming apparatus of the embodiment is designed to bring only one polishing member 10 into contact against the image carrier surface 1 after the toner image is transferred to the recording sheet 6. However, the image forming apparatus may also be designed to bring two or more such polishing members 10 into contact against the image carrier surface. Alternatively, the apparatus may also be adapted to use such a polishing member 10 in combination with the foam roller or rotary brush conventionally used as the dispersing member.

According to the image forming apparatus of the embodiment, one developing unit 4 supplies the toner t to one image carrier 1 so as to form the toner image, which is transferred to the recording sheet 6 as the transfer medium. However, the image forming apparatus of the invention is not limited to this.

Although the illustration is omitted, the invention may also be applied to a tandem-type full-color image forming apparatus wherein a plurality of developing units individually storing therein toners of different colors are provided with image carriers, wherein toner images of the individual colors are formed on the individual image carriers by means of the individual developing units, wherein the toner images thus formed in the individual colors on the individual image carriers are transferred to an intermediate transfer belt as the transfer medium, thus forming a full-colored toner image on the intermediate transfer belt 4, and wherein the resultant full-colored toner image is transferred from the intermediate transfer belt to the recording sheet. In such a tandem-type full-color image forming apparatus, as well, the aforementioned polishing members may be contacted against the individual image carrier surfaces after the transfer of the toner images to the intermediate transfer belt. The polishing members may be reciprocally moved in the axial direction of the individual image carriers, thereby uniformly polishing the individual surfaces of the image carriers. In the mean time, the bias voltage from the bias sources may be applied to the individual polishing members for properly controlling the charges of the toners remaining on the individual image carrier surfaces.

Next, description is made on an image forming apparatus according to a specific example of the invention, which employs the polishing member.

In this example, the aforementioned polishing member 10 was fabricated as follows. As shown in FIG. 7A, a foamed elastic material 11 comprising carbon-dispersed foamed polyurethane (INOAC CORPORATION: EMM-C) having a volume resistance on the order of $10^5$ to $10^6\Omega$ was affixed to the base 12. A conductive film comprising a carbon-dispersed polyethylene sheet (ACHILLES CORPORATION: Cropoly Sheet) having a thickness of 100 μm and a surface resistance on the order of $10^5$ to $10^6\Omega$ was bonded to the surface of the foamed elastic material 11.

Figure 9:
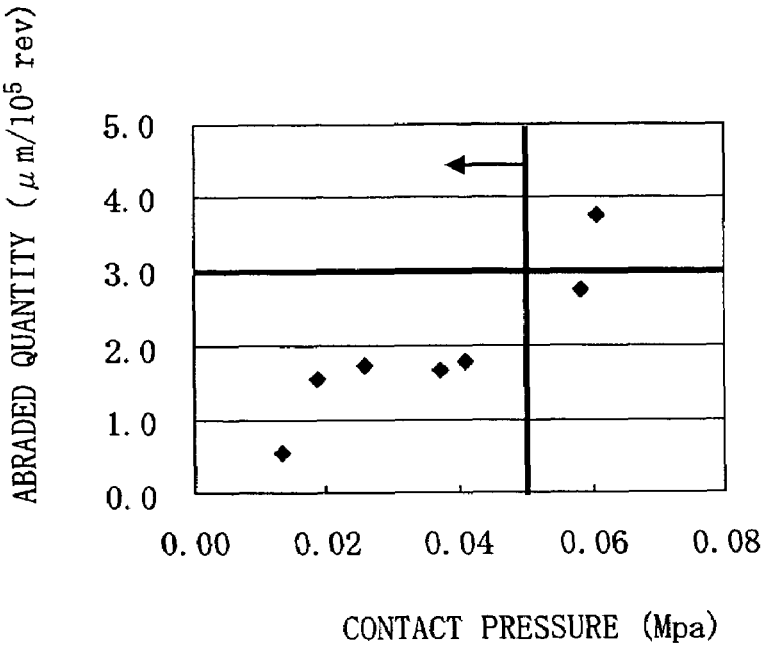
FIG. 9 is a group of graphs which shows a relation between the contact pressure of the polishing member against the image carrier and the abraded quantity of the image carrier of the image forming apparatus according to the embodiment of the invention, and which shows a relation between the contact pressure of the polishing member against the image carrier and the surface roughness Ra of the image carrier.
Figure 9:
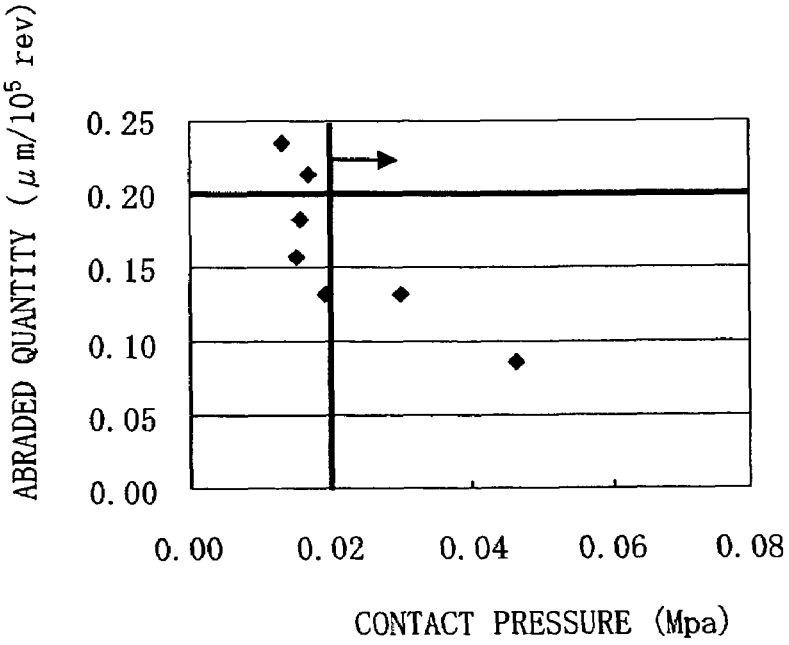

This polishing member was mounted to a commercially available image forming apparatus (KONIKA MINOLTA: Magicolor 5440DL), which was remodeled. A 30,000-cycling life test was conducted as follows under low temperature/low humidity conditions including a temperature of 10° C. and a humidity of 15%. That is, the polishing member had a nip width of 2 mm with respect to the image carrier. The polishing member was reciprocally moved in the axial direction of the image carrier with an amplitude of 10 mm and in a pitch of 0.8 based on one revolution of the image carrier. The contact pressure of the polishing member against the image carrier was varied as shown in the following table 1. There were determined the abraded quantity of the image carrier (μm/$10^5$ rev) and the arithmetic mean surface roughness Ra thereof. The results are shown in the following table 1 and table 2 as well as in FIG. 9A and FIG. 9B.

It is noted here that the abraded quantity of the image carrier (μm/$10^5$ rev) was determined as follows. FISCHERSCOPE (commercially available from FISCHER CORPORATION) was operated to take measurement on the abraded quantity of the image carrier making 30,000 revolutions. The abraded quantity of the image carrier making 100,000 revolutions was calculated based on the measurement result.

The arithmetic mean surface roughness Ra of the image carrier was measured according to JIS B0601 and by using SURFCOM 480A (commercially available from TOKYO SEIMITSU Co.Ltd.).

If the abraded quantity of the image carrier is less than 0.1 μm/$10^5$ rev, it is difficult to adequately prevent the filming of the toner and the like remaining on the image carrier surface after image transfer. If the abraded quantity exceeds 3.0 μm/$10^5$ rev, the surface of the image carrier is heavily abraded so that the image carrier suffers a significant decrease of the service life. If the arithmetic mean surface roughness Ra of the image carrier exceeds 0.2 μm, the image carrier adversely affects the image to be formed. It is therefore preferred that the abraded quantity of the image carrier is in the range of 0.1 to 3.0 μm/$10^5$ rev and that the surface roughness Ra of the image carrier is 0.2 μm or less.

TABLE 1

| CONTACT PRESSURE (MPa) | PITCH | AMPLITUDE (mm) | ABRADED QUANTITY (μm/$10^5$ rev) |
|---|---|---|---|
| 0.013 | 0.8 | 10 | 0.568 |
| 0.019 | 0.8 | 10 | 1.570 |
| 0.026 | 0.8 | 10 | 1.760 |
| 0.037 | 0.8 | 10 | 1.687 |
| 0.041 | 0.8 | 10 | 1.798 |
| 0.058 | 0.8 | 10 | 2.758 |
| 0.061 | 0.8 | 10 | 3.748 |

TABLE 2

| CONTACT PRESSURE (MPa) | PITCH | AMPLITUDE (mm) | Ra (μm) |
|---|---|---|---|
| 0.013 | 0.8 | 10 | 0.233 |
| 0.015 | 0.8 | 10 | 0.157 |
| 0.016 | 0.8 | 10 | 0.182 |
| 0.017 | 0.8 | 10 | 0.212 |
| 0.019 | 0.8 | 10 | 0.131 |
| 0.030 | 0.8 | 10 | 0.131 |
| 0.046 | 0.8 | 10 | 0.086 |

The results indicate that the abraded quantity of the image carrier is in the range of 0.1 to 3.0 μm/$10^5$ rev and the surface roughness Ra thereof is 0.2 μm or less if the contact pressure of the polishing member against the image carrier is controlled to the range of 0.02 MPa to 0.05 MPa.

Under the same low temperature/low humidity conditions as those described above which included the temperature of 10° C. and the humidity of 15%, each of the 30,000-cycling life tests was conducted as follows. That is, the polishing member had the nip width of 2 mm with respect to the image carrier. The polishing member was contacted against the image carrier at a pressure of 0.04 MPa. The polishing member was reciprocally moved in the axial direction of the image carrier with the amplitude of 10 mm. The pitch of the polishing member reciprocally moved in the axial direction of the image carrier was set to 0.8, 1.5 or 2.2 based on one revolution of the image carrier. The abraded quantity of the image carrier (μm/$10^5$ rev) and the arithmetic mean surface roughness Ra thereof were determined the same way as that described above. The results are shown in the following table 3.

TABLE 3

| CONTACT PRESSURE (MPa) | PITCH | AMPLITUDE (mm) | ABRADED QUANTITY (μm/$10^5$ rev) | Ra (μm) |
|---|---|---|---|---|
| 0.04 | 0.8 | 10 | 0.85 | 0.18 |
| 0.04 | 1.5 | 10 | 2.16 | 0.18 |
| 0.04 | 2.2 | 10 | 3.10 | 0.16 |

The results indicate a tendency that with the increase of the pitch of the polishing member reciprocally moved in the axial direction of the image carrier based on one revolution of the image carrier, the image carrier is accordingly increased in the abraded quantity and is slightly increased in the arithmetic mean surface roughness Ra.

Under the same low temperature/low humidity conditions as those described above which included the temperature of 10° C. and the humidity of 15%, each of the 30,000-cycling life tests was conducted as follows. That is, the polishing member had the nip width of 2 mm with respect to the image carrier. The polishing member was contacted against the image carrier at the pressure of 0.04 MPa. The polishing member was reciprocally moved in the axial direction of the image carrier in the pitch of 1.5 based on one revolution of the image carrier. The amplitude of the polishing member reciprocally moved in the axial direction of the image carrier was set to 6 mm, 10 mm or 20 mm. The abraded quantity of the image carrier (μm/$10^5$ rev) and the arithmetic mean surface roughness Ra thereof were determined the same way as that described above. The results are shown in the following table 4.

TABLE 4

| CONTACT PRESSURE (MPa) | PITCH | AMPLITUDE (mm) | ABRADED QUANTITY (μm/$10^5$ rev) | Ra (μm) |
|---|---|---|---|---|
| 0.04 | 1.5 | 6 | 1.73 | 0.21 |
| 0.04 | 1.5 | 10 | 2.16 | 0.18 |
| 0.04 | 1.5 | 20 | 2.25 | 0.15 |

The results indicate a tendency that with the increase of the amplitude of the polishing member reciprocally moved in the axial direction of the image carrier, the image carrier is slightly increased in the abraded quantity but is decreased in the arithmetic mean surface roughness Ra.

If the contact pressure of the polishing member contacted against the image carrier surface is controlled to the range of 0.02 MPa to 0.05 MPa, the image carrier is prevented from being increased in the surface roughness or in the abrasion of the surface thereof. In addition, the toner and the like remaining on the image carrier surface after image transfer are adequately prevented from filming as fused thereto.

Particularly, if the arithmetic mean surface roughness Ra of the image carrier polished by the polishing member is controlled to 0.2 μm or less, the image carrier is prevented from being so increased in the surface roughness as to adversely affect the image to be formed. Furthermore, if the abraded quantity of the image carrier by means of the polishing member is controlled to the range of 0.1 to 3.0 μm/$10^5$ rev, the toner and the like remaining on the image carrier surface after image transfer are adequately removed so that the filming of the toner and the like is obviated. In addition, the image carrier is also prevented from suffering the decreased service life resulting from the increased abraded quantity of the surface thereof.

If the bias voltage is applied to the above polishing member for controlling the electric charge of the residual toner on the image carrier surface, the toner remaining on the image carrier surface after image transfer may be properly collected by the developing unit.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

The invention claimed is:

1. An image forming apparatus comprising:

an image carrier driven into rotation;

a charger for electrically charging a surface of the image carrier;

a latent image forming unit for forming an electrostatic latent image on the charged image carrier surface;

a developing unit for forming a toner image by supplying a toner to an area of the electrostatic latent image formed on the image carrier surface;

a transferring unit for transferring the toner image formed on the image carrier surface to a transfer medium; and a non-rotary type polishing member comprises a foamed elastic material affixed to a base, the polishing member has a configuration wherein a portion which contacts the image carrier is defined by a protruded curve as seen in a vertical section with respect to a longitudinal direction of the base, the polishing member contacted against the surface of the image carrier at place downstream from the transferring unit in a moving direction of the image carrier and between the transferring unit and the charger, and reciprocally moved in a direction intersecting with the moving direction of the image carrier.

2. An image forming apparatus comprising:

an image carrier driven into rotation;

a charger for electrically charging a surface of the image carrier;

a latent image forming unit for forming an electrostatic latent image on the charged image carrier surface;

a developing unit for forming a toner image by supplying a toner to an area of the electrostatic latent image formed on the image carrier surface;

a transferring unit for transferring the toner image formed on the image carrier surface to a transfer medium; and a non-rotary type polishing member employing a foamed elastic material, the polishing member contacted against the surface of the image carrier at place downstream from the transferring unit in a moving direction of the image carrier and between the transferring unit and the charger, and reciprocally moved in a direction intersecting with the moving direction of the image carrier, wherein the polishing member is contacted against the image carrier surface at a contact pressure of 0.02 MPa to 0.05 MPa.

3. An image forming apparatus comprising:

an image carrier driven into rotation;

a charger for electrically charging a surface of the image carrier;

a latent image forming unit for forming an electrostatic latent image on the charged image carrier surface;

a developing unit for forming a toner image by supplying a toner to an area of the electrostatic latent image formed on the image carrier surface;

a transferring unit for transferring the toner image formed on the image carrier surface to a transfer medium; and a non-rotary type polishing member employing a foamed elastic material, the polishing member contacted against the surface of the image carrier at place downstream from the transferring unit in a moving direction of the image carrier and between the transferring unit and the charger, and reciprocally moved in a direction intersecting with the moving direction of the image carrier, wherein the polishing member has a film sheet laid over a surface of the foamed elastic material and contacted against the image carrier surface.

4. An image forming apparatus according to claim 3, wherein the film sheet is bonded to the surface of the foamed elastic material.

5. An image forming apparatus according to claim 3, wherein the film sheet is a conductive film.

6. An image forming apparatus according to claim 1 comprising:

an image carrier driven into rotation;

a charger for electrically charging a surface of the image carrier;

a latent image forming unit for forming an electrostatic latent image on the charged image carrier surface;

a developing unit for forming a toner image by supplying a toner to an area of the electrostatic latent image formed on the image carrier surface;

a transferring unit for transferring the toner image formed on the image carrier surface to a transfer medium; and a non-rotary type polishing member employing a foamed elastic material, the polishing member contacted against the surface of the image carrier at place downstream from the transferring unit in a moving direction of the image carrier and between the transferring unit and the charger, and reciprocally moved in a direction intersecting with the moving direction of the image carrier, wherein when abraded by the polishing member, the image carrier has an arithmetic mean surface roughness Ra of 0.2 μm or less and an abraded quantity in the range of 0.1 to 3.0 $\mu m/10^5$ rev.

7. An image forming apparatus according to claim 1, wherein a bias voltage is applied to the polishing member for controlling the electric charge of the toner remaining on the image carrier surface after image transfer.

8. In an image forming apparatus including: an image carrier driven into rotation; a charger for electrically charging a surface of the image carrier; a latent image forming unit for forming an electrostatic latent image on the charged image carrier surface; a developing unit for forming a toner image by supplying a toner to an area of the electrostatic latent image formed on the image carrier surface; and a transferring unit for transferring the toner image formed on the image carrier surface to a transfer medium, a method of polishing the image carrier comprising the steps of:

providing a non-rotary type polishing member comprising a formed elastic material and having a configuration wherein a portion which contacts the image carrier is defined by a protruded curve as seen in a vertical section with respect to a longitudinal direction of the base;

bringing the non-rotary type polishing member employing the foamed elastic material into contact against the image carrier surface at place downstream from the transferring unit in a moving direction of the image carrier and between the transferring unit and the charger; and reciprocally moving the polishing member in a direction intersecting with the moving direction of the image carrier.

9. A polishing method according to claim 8, wherein a bias voltage is applied to the polishing member for controlling the electric charge of the toner remaining on the image carrier surface after image transfer.

10. In an image forming apparatus including: an image carrier driven into rotation: a charger for electrically charging a surface of the image carrier; a latent image forming unit for forming an electrostatic latent image on the charged image carrier surface; a developing unit for forming a toner image by supplying a toner to an area of the electrostatic latent image formed on the image carrier surface; and a transferring unit for transferring the toner image formed on the image carrier surface to a transfer medium, a method of polishing the image carrier comprising the steps of:

bringing a non-rotary type polishing member employing a foamed elastic material into contact against the image carrier surface at place downstream from the transferring unit in a moving direction of the image carrier and between the transferring unit and the charger; and reciprocally moving the polishing member in a direction intersecting with the moving direction of the image carrier, wherein the polishing member is contacted against the image carrier surface at a contact pressure of 0.02 MPa to 0.05 MPa.

11. In an image forming apparatus including: an image carrier driven into rotation; a charger for electrically charging a surface of the image carrier; a latent image forming unit for forming an electrostatic latent image on the charged image carrier surface; a developing unit for forming a toner image by supplying a toner to an area of the electrostatic latent image formed on the image carrier surface; and a transferring unit for transferring the toner image formed on the image carrier surface to a transfer medium, a method of polishing the image carrier comprising the steps of:

bringing a non-rotary type polishing member employing a foamed elastic material into contact against the image carrier surface at place downstream from the transferring unit in a moving direction of the image carrier and between the transferring unit and the charger; and reciprocally moving the polishing member in a direction intersecting with the moving direction of the image carrier, wherein the polishing member has a film sheet laid over a surface of the foamed elastic material and contacted against the image carrier surface.

12. A polishing method according to claim 11, wherein the film sheet is bonded to the surface of the foamed elastic material.

13. A polishing method according to claim 11, wherein the film sheet is a conductive film.

14. In an image forming apparatus including: an image carrier driven into rotation; a charger for electrically charging a surface of the image carrier; a latent image forming unit for forming an electrostatic latent image on the charged image carrier surface; a developing unit for forming a toner image by supplying a toner to an area of the electrostatic latent image formed on the image carrier surface; and a transferring unit for transferring the toner image formed on the image carrier surface to a transfer medium, a method of polishing the image carrier comprising the steps of:

bringing a non-rotary type polishing member employing a foamed elastic material into contact against the image carrier surface at place downstream from the transferring unit in a moving direction of the image carrier and between the transferring unit and the charger; and reciprocally moving the polishing member in a direction intersecting with the moving direction of the image carrier, wherein when abraded by the polishing member, the image carrier has an arithmetic mean surface roughness Ra of 0.2 μm or less and an abraded quantity in the range of 0.1 to 3.0 $\mu m/10^5$ rev.

* * * * *